United States Patent [19]

Fenwick

[11] Patent Number: 5,024,078

[45] Date of Patent: Jun. 18, 1991

[54] MAGNETIC KEY CHAIN

[76] Inventor: Lawrence M. Fenwick, 514 North East St., Kewanee, Ill. 61443

[21] Appl. No.: 484,508

[22] Filed: Feb. 26, 1990

[51] Int. Cl.[5] ..... A47G 29/10

[52] U.S. Cl. ..... 70/456 R; 70/45 B

[58] Field of Search ..... 70/456 R, 456 B, 457, 70/458, 459, 413; 403/DIG. 1; 292/251.5

[56] References Cited

U.S. PATENT DOCUMENTS 3,730,577 5/1973 Shanok ..... 292/251.5
3,863,477 2/1975 Klein ..... 70/456 R
4,432,219 2/1984 Bassett ..... 70/456 R

*Primary Examiner*—Robert L. Wolfe
*Attorney, Agent, or Firm*—Hill, Van Santen, Steadman & Simpson

[57] ABSTRACT

A magnetic key chain which comprises a plastic material in which particles are embedded so that it will adhere to a metal surface such as iron or steel and which in at least one embodiment has a covering sheet on one side and which carries a key ring to which keys can be attached so as to magnetically support the keys from a metal surface when at least one side of the key ring engages the metal surface.

1 Claim, 2 Drawing Sheets

FIG. 5
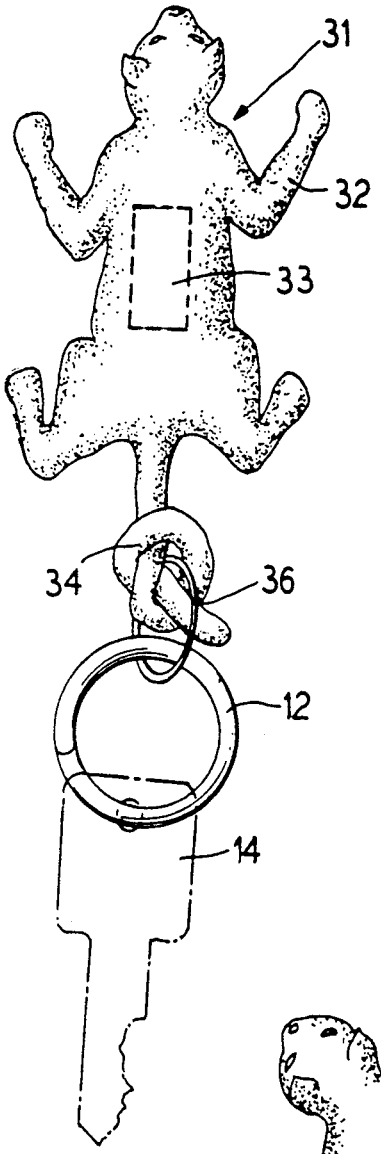
FIG. 6
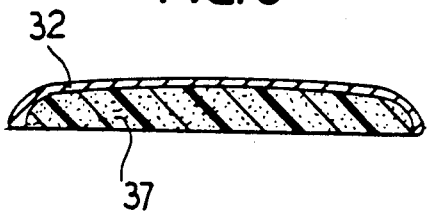
FIG. 8
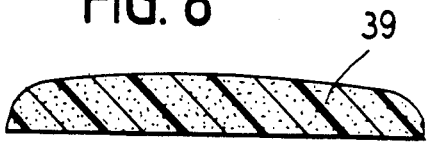
FIG. 9
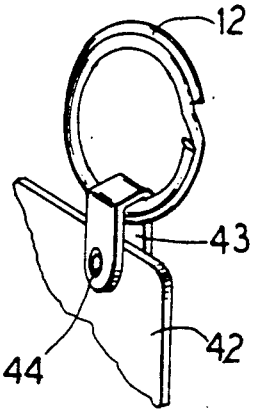
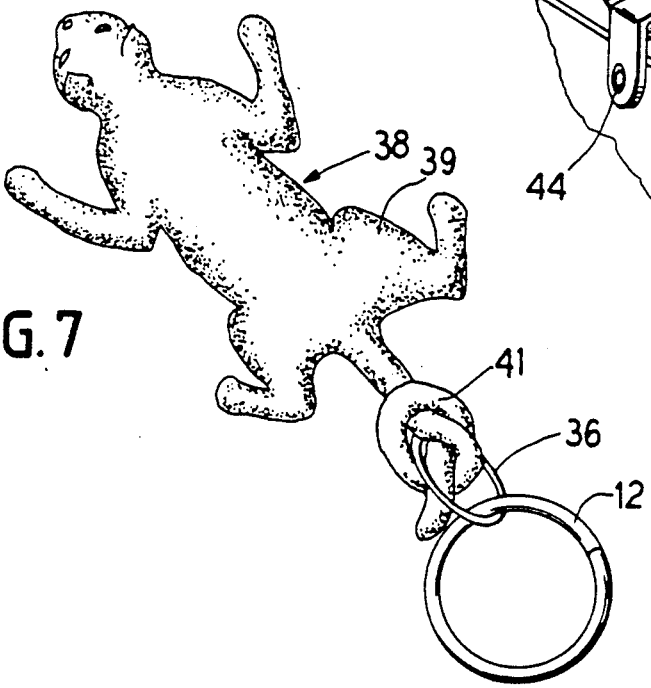
FIG. 7

MAGNETIC KEY CHAIN

CROSS-REFERENCE TO RELATED APPLICATIONS

This invention is related to my invention entitled "MAGNETIC DISPLAY DEVICE", U.S. Ser. No. 421,967, filed Oct. 16, 1989.

BACKGROUND OF THE INVENTION

1. Field of the Invention

This invention relates in general to a magnetic key ring which includes a plastic into which magnetic particles are embedded so that it can be attached to a metal surface.

2. Description of the Prior Art

Key rings have been attached to metal surface by the use of small magnets which are placed on the key ring to attach it to a metal surface. However, the use of such magnets are inconvenient in that the magnets must be available when it is desired to attach a key ring to a metal surface.

SUMMARY OF THE INVENTION

The present invention relates to a magnetic key ring which comprises a layer of plastic in which are embedded magnetic particles and a key ring is formed from the layer of plastic by attaching a key ring thereto such that the key ring can be supported by the layer of plastic which contains the magnetic particles. A protective nonmagnetic coating may be applied to one side of the layer of plastic containing magnetic particles such that the key ring will be supported by the metal surface only if the magnetic particle side of the key ring engages the flat surface. The key ring may be attached to a refrigerator or other metal surface and the magnetic attraction of the magnetic particles will firmly hold the key ring in position.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

BRIEF DESCRIPTION OF THE DRAWINGS

FIG. 5 is a top view of a modification;

FIG. 6 is a sectional view of a modification;

FIG. 7 is a modification;

FIG. 8 is a sectional through view through FIG. 7; and

FIG. 9 is a cut-away fragmentary view.

DESCRIPTION OF THE PREFERRED EMBODIMENTS

Figure 1:
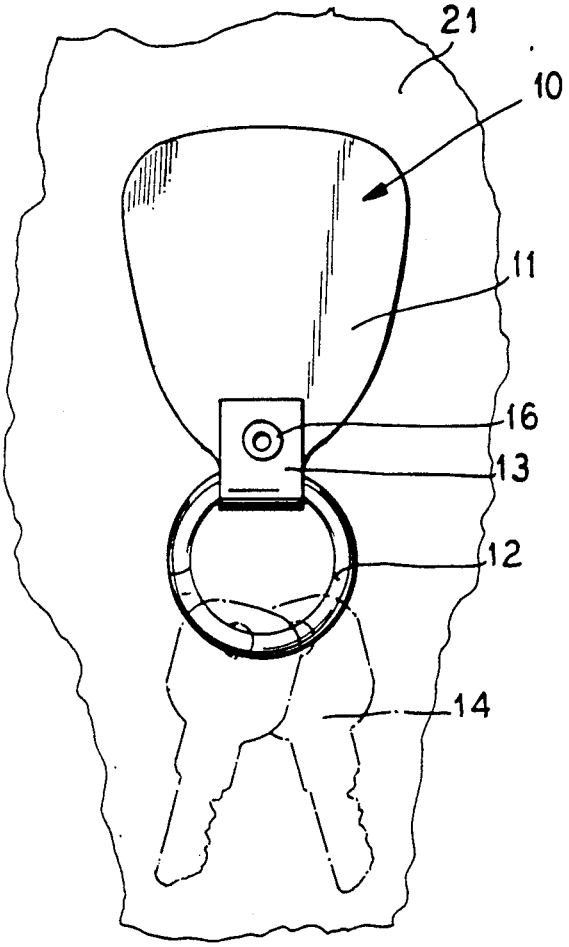
FIG. 1 is a plan view of the magnetic key ring of the invention mounted on a metal supporting surface.
Figure 2:
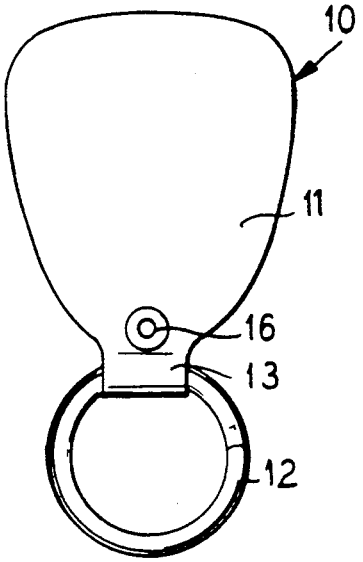
FIG. 2 is a plan view of the key ring showing the other side of the key ring.
Figure 3:
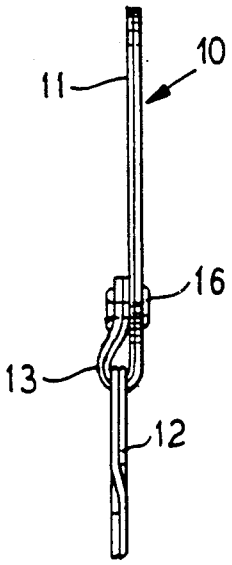
FIG. 3 is a side view of the key ring.
Figure 4:
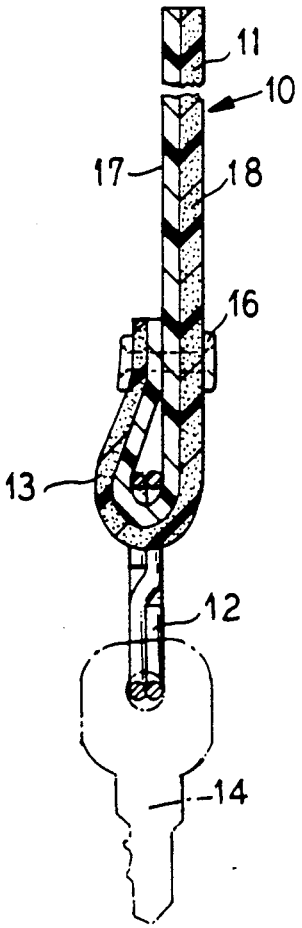
FIG. 4 is an enlarged partially cutaway sectional side view of the key ring.

FIG. 1 illustrates a key ring 10 which has a tag portion 11 which may be any shape but which is illustrated as a somewhat oval shape which has an end connecting portion 13 which supports a key ring 12 to which keys 14 can be mounted. A brad 16 extends through the holding member 13 and the tag member 11 to lock the key ring 12 to the tag portion 11. As best shown in FIG. 4, the tag member 11 and the holder portion 13 may be formed of a plastic layer 18 into which magnetic particles are embedded so that the layer 18 of the tag will attach to a metal surface such as the surface 21 illustrated in FIG. 1 to magnetically support the key ring 10 and the keys 14. A second covering layer 17 of nonmagnetic plastic may be attached to the layer 18 as shown in FIG. 4.

The tag 11 may be of various shapes such as oval, rectangular or irregular shapes and can be formed with a suitable cutting die. The holding member 13 can be attached by the brad 16 to lock a key ring 12 to the tag 11.

In use, the tag 11 of the key ring 10 can be placed in contact with the vertical surface of a metal member 21 and the magnetic particles contained in the layer 18 will support and hold the key ring to the metal surface 21. This makes the key ring and keys readily available for removal as desired.

FIG. 5 illustrates a modification of the invention wherein a somewhat hollow stamping 31 is formed with a metal outer covering 32 in the shape of a selected object, such as a cat. A magnet 33 may be attached to the underside of the covering 32. The covering 32 may have a tail 34 with an opening in which a ring 36 is mounted and the ring 36 can be joined with a key ring 12 which supports a key 14.

FIG. 6 illustrates in section a modification wherein the stamping 32 is filed with plastic magnetic material 37 so as to magnetically support the stamping 31.

FIG. 7 illustrates another embodiment in which the metal stamping is eliminated and the key holder 38 is formed from a magnetic plastic 39 which is also shown in FIG. 8. The tail 41 supports ring 36 which is joined to key ring 12.

FIG. 8 is a sectional view of FIG. 7.

FIG. 9 illustrates a modification of the embodiment shown in FIGS. 1–4 wherein the body 42 is joined to the key ring 12 by a separate coupling strip 43 which is connected to body 42 by a rivet 44.

Although the invention has been described with respect to preferred embodiments, it is not to be so limited as changes and modifications can be made which are within the full intended scope of the invention as defined by the appended claims.

I claim as my invention:

1. A magnetic key ring comprising a body of plastic material in which magnetic particles are embedded and formed into a three dimensional shape of an animal or other device and formed with one side which is substantially planar and a key ring attached to said body of plastic material, and including a metallic cover member which has the same configuration as said body of plastic mate rial into which said body of plastic material is received.

* * * * *